US009364053B2

(12) United States Patent
Seki

(10) Patent No.: US 9,364,053 B2
(45) Date of Patent: Jun. 14, 2016

(54) FASTENER ELEMENT

(75) Inventor: Kosuke Seki, Toyama (JP)

(73) Assignee: YKK Corporation (JP)

( * ) Notice: Subject to any disclaimer, the term of this patent is extended or adjusted under 35 U.S.C. 154(b) by 161 days.

(21) Appl. No.: 14/236,643

(22) PCT Filed: Aug. 24, 2011

(86) PCT No.: PCT/JP2011/069067

§ 371 (c)(1),
(2), (4) Date: Feb. 3, 2014

(87) PCT Pub. No.: WO2013/027281

PCT Pub. Date: Feb. 28, 2013

(65) Prior Publication Data

US 2014/0182092 A1 Jul. 3, 2014

(51) Int. Cl.

| | |
|---|---|
| ***A44B 19/26*** | (2006.01) |
| ***A44B 19/06*** | (2006.01) |
| *A44B 19/40* | (2006.01) |

(52) U.S. Cl.

CPC ..... *A44B 19/26* (2013.01); *A44B 19/06* (2013.01); *A44B 19/403* (2013.01); *Y10T 24/2588* (2015.01)

(58) Field of Classification Search

CPC ..... A44B 19/06; A44B 19/26; A44B 19/403; A44B 19/04; A44B 19/382; Y10T 24/2588; Y10T 24/2554; Y10T 24/2552; Y10T 24/2559; Y10T 29/49785; Y10T 24/255; Y10T 29/4979; Y10T 24/2539; B21D 53/52

USPC ..... 24/409–411, 414, 430

See application file for complete search history.

(56) References Cited

U.S. PATENT DOCUMENTS 2,116,712 A 5/1938 Prentice
2,489,718 A * 11/1949 Morin ..... B21D 53/52 24/410

(Continued)

FOREIGN PATENT DOCUMENTS

CA 1283276 A 4/1991
CN 102006797 A 4/2011

(Continued)

OTHER PUBLICATIONS

Supplementary European Search Report, European Patent Application No. 11871214.0, mailed May 5, 2015.
International Search Report, PCT Application No. PCT/JP2011/069067, mailed Nov. 15, 2011.

*Primary Examiner* — Robert J Sandy
*Assistant Examiner* — David Upchurch
(74) *Attorney, Agent, or Firm* — Kilpatrick Townsend & Stockton LLP

(57) ABSTRACT

A fastener element includes a coupling head and a pair of leg portions and has a coupling concave portion provided on a first surface of the coupling head and a coupling convex portion projecting from a second surface of the coupling head. An outer margin portion on a first surface side of the coupling head has a first margin portion formed like a ridge line and a pair of second margin portions disposed on both sides of the first margin portion and formed like an inclined surface or a curved surface and one end of each of the second margin portions is arranged on an inside of both end positions of a width direction of the coupling concave portion. Accordingly, the feel of the fastener element can be improved and also the strength of the slide fastener with respect to transverse pulling can stably be maintained.

11 Claims, 4 Drawing Sheets

(56) References Cited

U.S. PATENT DOCUMENTS

| | | | | |
|---|---|---|---|---|
| 4,651,388 | A | 3/1987 | Horikawa et al. | |
| 5,394,593 | A | 3/1995 | Aoki | |
| 5,671,510 | A * | 9/1997 | Maeda | A44B 19/46 24/403 |
| 6,913,835 | B2 * | 7/2005 | Aoki | A44B 19/06 428/577 |
| 2011/0010899 | A1 | 1/2011 | Kozato et al. | |

FOREIGN PATENT DOCUMENTS

| | | | |
|---|---|---|---|
| EP | 0175198 | A2 | 3/1986 |
| EP | 2263493 | A1 | 12/2010 |
| FR | 1217364 | A | 5/1960 |
| GB | 2164388 | A | 3/1986 |
| JP | 61-52912 | U | 4/1986 |
| WO | 2009/128136 | A1 | 10/2009 |

* cited by examiner

FASTENER ELEMENT

This application is a national stage application of PCT/JP2011/069067, which is incorporated herein by reference.

TECHNICAL FIELD

The invention relates to a fastener element made of metal for a slide fastener that can stably maintain an engaging strength of the slide fastener and provides a smooth feel.

BACKGROUND ART

A fastener element made of metal (hereinafter, may simply be called a metallic element) generally includes a coupling head, a body extending backward from a base end portion of the coupling head, and a pair of left and right leg portions extending backward after being bifurcated from the body. Such a metallic element is manufactured by two representative methods described below.

According to a first manufacturing method of a metallic element, a coupling head or the like is molded by plastic deformation of a rectangular wire material made of metal with a pressing force and the molded rectangular wire material is punched or cut into an element shape using a punch, die or the like to manufacture each fastener element in a scattered state.

Fastener elements obtained as described above undergo a polishing process such as barrel polishing or chemical polishing and a coating process that applies a clear coating to the element surface and then, one fastener element after another is planted to one side edge portion of a fastener tape at predetermined intervals using a caulking means. Accordingly, a fastener stringer in which a plurality of metallic elements is attached to the fastener tape in a row is manufactured successively.

An example of the method of manufacturing metallic elements from a rectangular wire material as described above is disclosed by U.S. Pat. No. 2,116,712 (Patent Document 1). Particularly, according to the manufacturing method described in Patent Document 1, before a coupling head or the like is molded, a pressing force is applied to left and right edge portions along the longitudinal direction of a rectangular wire material by the rectangular wire material being passed between a pair of rollers. Accordingly, square left and right side edge portions of a rectangular wire material are rounded to form a smooth surface.

A coupling head or the like is molded by applying a pressing force to a wire made of metal whose left and right side edge portions are rounded and then the wire is cut by a cutting die into an element shape and also a leg portion is extended in the width direction by punching. Accordingly, as shown in FIG. 7, a metallic element 50 whose outer edge portions on left and right sides on first and second surface sides (lower and upper surface sides) of a coupling head 51 and leg portions 52 are rounded is manufactured.

According to Patent Document 1, by configuring a slide fastener using the metallic element 50 described above, outer edge portions of the metallic element 50 are smooth and so the slider can be slidingly moved more easily and also the noise produced while the slider is slidingly moved can be reduced.

On the other hand, according to a second manufacturing method of a metallic element, a long metallic wire having a circular cross section is first passed through a plurality of pressure rolls to mold the wire so as to have a transverse section in a substantial Y shape and the molded wire (so-called Y bar) is successively cut with a desired thickness in the length direction using a cutting punch and a cutting die to successively produce an element component. Subsequently, a portion corresponding to a coupling head of the obtained element component is locally deformed by applying a pressing force to mold a coupling convex portion and a coupling concave portion to manufacture a metallic element.

Subsequent to the molding of the coupling convex portion and the coupling concave portion, metallic elements obtained as described above are planted to one side edge portion of a fastener tape transferred separately from the metallic elements one by one using a caulking means (caulking punch) to manufacture a fastener stringer.

Patent Document 1: U.S. Pat. No. 2,116,712

SUMMARY OF THE INVENTION

Problems to be Solved by the Invention

The fastener element 50 described in Patent Document 1 is configured by, as shown in FIG. 7, outer edge portions on the left and right sides of the coupling head 51 and the leg portions 52 being rounded, but portions formed rounded and smoothly are only outer edge portions on the left and right sides of the coupling head 51 and the leg portions 52 and a center margin portion on a tip end portion side disposed between outer edge portions on the left and right sides of the coupling head 51 remains a cut edge cut by a cutting die and the cross section of the center margin portion has an outer shape like a square ridge line at substantially right angles.

Thus, if a slide fastener is configured by using the fastener element 50 described in Patent Document 1, for example, when a user opens the slide fastener and inserts his (her) hand into an opening that is wide open, the hand comes easily into contact with the tip end margin portion on the coupling head 51 side of the fastener element 50 (particularly when the tip end margin portion is formed in a curved shape like being curved or bent from a tip parallel region parallel to the element width direction to the outer edge portions on the left and right sides of the coupling head, the curved region).

In this case, with an outer shape like, as described above, a square ridge line on the tip end side margin portion of the coupling head 51 in the fastener element 50 in Patent Document 1, when the user inserts his (her) hand into an opening of the slide fastener and the hand comes into contact with the fastener element 50 , unfortunately the user is more likely to have a rough feel of prickling or a slightly scratched feel.

Incidentally, when a slide fastener is configured by using a plurality of metallic elements in which a coupling concave portion is disposed on a first surface of the coupling head and a coupling convex portion is disposed on a second surface on the opposite side of the first surface, if the slide fastener in a closed state is subjected to a transverse pulling force that pulls the left and right fastener tapes to the outer side, the coupling convex portion of each fastener element touches an inner wall surface of the coupling concave portion of the engaging counterpart (particularly, an inner wall surface on the coupling head tip end side of the coupling concave portion) and a state in which the coupling convex portion is fitted into the coupling concave portion is maintained. This can thereby prevent chain breaking of the slide fastener.

However, for example, in a fastener element in which the tip end margin portion parallel to the width direction on the tip end portion side in the coupling head is formed, in contrast to the margin portion like an edge line as described in Patent Document 1, in a rounded curved shape whose square corners have been cut away, the thickness (hereinafter, this thickness will be called a top surface side thickness) in the element longitudinal direction from an inner wall surface of the coupling concave portion to an outer side face of the tip end portion (top surface of the coupling head) in the tip end portion of the coupling head becomes thinner as the first surface side of the coupling head becomes closer.

When a slide fastener is configured by using such a fastener element, if the slide fastener in a closed state is subjected to a transverse pulling force, the coupling convex portion of each fastener element touches an inner wall surface of the coupling concave portion of the engaging counterpart and a pressing force is applied to the inner wall surface. In this case, however, the above-mentioned thickness on the top surface side in each fastener element is thin and thus, when the inner wall surface of the coupling concave portion is subjected to a pressing force, the tip end portion of the coupling head of the engaging counterpart is more easily-deformed plastically like being bent to the outer side. As a result, a state in which the coupling convex portion of each fastener element is fitted into the coupling concave portion of the engaging counterpart cannot be maintained, posing a problem of decreasing strength of transverse pulling in a slide fastener.

The invention is made in view of the above problems and a concrete object thereof is to provide a fastener element made of metal capable of improving a smooth feel of a slide fastener by making a rough feel of prickling or a slightly scratched feel less likely when a user inserts his (her) hand into an opening of the slide fastener and which does not cause degradation in strength with respect to transverse pulling and further degradation in strength with respect to bending or with respect to pushing up of a slide fastener.

Means for Solving the Problems

To achieve the above object, a fastener element provided based on the invention is a fastener element made of metal for a slide fastener including as a basic configuration a coupling head and a pair of leg portions bifurcated and extended from the coupling head via a hip, having the coupling concave portion provided on a first surface of the coupling head and the coupling convex portion projecting from a second surface of the coupling head, the fastener element being characterized in that an outer margin portion on the first surface side of the coupling head has a first margin portion disposed in a center region of a tip end side of the coupling head and formed by the first surface and an outer side face of the coupling head like a ridge line and a pair of second margin portions disposed on both sides in an element width direction of the first margin portion and formed like a downward inclined surface or like a curved surface swelling to an outer side from the first surface to the outer side face and one end on a first margin portion side of each of the second margin portions is arranged on an inside of both end positions of a width direction of the coupling concave portion in the element width direction with respect to the coupling concave portion.

In the fastener element according to the invention, the other end on a leg side of the second margin portions is preferably arranged on a side of the leg of an edge position on a coupling head tip end side of the coupling concave portion in an element longitudinal direction with respect to the coupling concave portion.

Also in the fastener element according to the invention, the second margin portion is preferably disposed by being spaced from the coupling concave portion and the first surface of the coupling head is continuously disposed between the second margin portions and the coupling concave portion from a side region of the coupling concave portion to a tip end side region of the coupling head.

Further, in the fastener element according to the invention, an interval between the one ends of the pair of second margin portions is preferably set to 20% or more and 65% or less of a maximum dimension in the element width direction of the coupling head.

Further, in the invention, the outer margin portion on the first surface side of the fastener element preferably includes a tip parallel region disposed on a tip end side of the coupling head and parallel to the element width direction, a pair of side edge regions disposed along the element longitudinal direction extending over the coupling head and the leg, and a pair of curved regions connecting the tip parallel region and the side edge regions in a curved shape or a bent shape and the second margin portion is disposed in a range covering at least the entire curved regions.

Also in the fastener element according to the invention, a third margin portion formed like the downward inclined surface or like the curved surface swelling to the outer side from the first surface to the outer side face is preferably disposed in the outer margin portion on the first surface side of the leg.

In this case, the second margin portion and the third margin portion are preferably continuously formed. Alternatively, the second margin portion and the third margin portion are preferably formed by being spaced from each other.

Effects of the Invention

In a fastener element according to the invention, at least a first margin portion (ridge line portion) like a ridge line disposed in a center region and a pair of second margin portions continuously disposed on both sides of the first margin portion are provided in an element width direction on a coupling head tip end side in an outer margin portion on a first surface side where a coupling concave portion of a coupling head is provided.

A first margin portion of the invention is formed in a non-chamfered square outer surface shape like a ridge line. On the other hand, a second margin portion in the invention is formed like a downward inclined shape or like a convex curved surface swelling to an outer side from a first surface to an outer side face of the coupling head by being subjected to a chamfering and the outer surface shape from the first surface to the outer side face in the second margin portion is formed more smoothly than the first margin portion in a ridge line shape. In the invention, the outer side face of the coupling head means a series of side faces that appear to the outside when the coupling head is viewed from a tip end portion side and left and right edge sides.

With the second margin portions having a smooth outer surface shape disposed on both sides in the element width direction of the first margin portion in the outer margin portion on the first surface side of the coupling head, when a slide fastener is formed by using the fastener elements, even if a user inserts his (her) hand into an opening of the open slide fastener and touches the fastener element, the user is less likely to sense a rough feel of prickling or a slightly scratched feel as described in Patent Document 1 and a feel of the fastener element can be improved.

Particularly in the fastener element of the invention, one end on the first margin portion side of the second margin portions, that is, the boundary portion between the first margin portion and the second margin portion is arranged on the inside of positions of both ends in the width direction of the coupling concave portion in the element width direction with respect to the coupling concave portion and therefore, a feel of the fastener element can stably be improved.

Also in the fastener element of the invention, the square first margin portion like a ridge line is disposed between the pair of second margin portions and therefore, as described above, a feel of the fastener element can be improved by the second margin portion and at the same time, the thickness (top surface side thickness) in an element longitudinal direction from an inner wall surface of the coupling concave portion to a top surface of the coupling head in a tip end portion of the coupling head can stably be maintained.

Therefore, if a slide fastener is formed by using the fastener elements in the invention, when the slide fastener is subjected to a transverse pulling force, even if a coupling convex portion of each fastener element touches to give a pressing force to the inner wall surface on a coupling head tip end side of the coupling concave portion of the engaging counterpart, the tip end portion of the coupling head can be inhibited from being plastically deformed like being bent due to the thickness on the top surface side of each fastener element.

Accordingly, this can effectively prevent chain breaking of the slide fastener by stably maintaining a state in which the coupling convex portion of each fastener element is fitted into the coupling concave portion of the engaging counterpart and therefore, a large strength with respect to transverse pulling of the slide fastener can easily be maintained. Further, because plastic deformation of the coupling concave portion can be inhibited, the slide fastener can also maintain lasting sufficient strength with respect to bending or pushing up.

In the aforementioned fastener element of the invention, the other end on a leg side of the second margin portion is arranged on a leg portion side of an edge position on the coupling head tip end side of the coupling concave portion in the element longitudinal direction with respect to the coupling concave portion. Accordingly, a feel of the fastener element can be improved more stably by maintaining a larger region for the second margin portion disposed in the coupling head.

Also in the fastener element of the invention, the second margin portion is disposed by being spaced from the coupling concave portion and the first surface of the coupling head is continuously disposed between the second margin portion and the coupling concave portion from a side region of the coupling concave portion to a region on the coupling head tip end side. Accordingly, the strength of the slide fastener with respect to transverse pulling can further be increased by stably maintaining the strength of a periphery of the coupling concave portion.

In the fastener element of the invention, an interval between the one ends on the first margin portion side of the pair of second margin portions, in other words, the interval of the first margin portion like a ridge line is set to 20% or more of a maximum dimension in the element width direction of the coupling head. Accordingly, the strength of the slide fastener with respect to transverse pulling can effectively be increased by easily maintaining the top surface side thickness in the coupling head.

Also in the invention, with the interval between the one ends of the pair of second margin portions set to 65% or less of the maximum dimension in the element width direction of the coupling head, a feel of the fastener element can more reliably be enhanced by effectively be providing the second margin portion having a smooth outer surface shape in a region with which a user's hand comes easily into contact in the outer margin portion on the first surface side of the coupling head.

Further, the outer margin portion on the first surface side of the fastener element in the invention includes a tip parallel region disposed on the coupling head tip end side and parallel to the element width direction, a pair of left and right side edge regions disposed along the element longitudinal direction extending over the coupling head and the leg portion, and a pair of left and right curved regions connecting the tip parallel region and the side edge regions in a curved shape or a bent shape and the second margin portion having a smooth outer surface shape is disposed in a range covering at least the entire curved regions. Accordingly, the second margin portion is reliably provided in a region with which a user's hand comes easily into contact in the outer margin portion on the first surface side of the coupling head and therefore, a feel of the fastener element can stably be enhanced.

Also in the fastener element of the invention, a third margin portion configured like a downward inclined surface or like a curved surface swelling to the outer side from the first surface to outer side face is disposed in the outer margin portion on the first surface side of the leg portion. Accordingly, a feel and appearance of the fastener element can further be improved and also when a slide fastener is configured by using the fastener elements of the invention, sliding resistance of a slider to the fastener element can be made smaller so that opening and closing operations of the slide fastener can smoothly be performed.

In this case, with the second margin portion and the third margin portion formed continuously in the outer margin portion of the fastener element, a feel and appearance of the fastener element can be improved still more and when a slide fastener is configured, the slider can be slidingly moved more smoothly with respect to the fastener element.

On the other hand, when the second margin portion and the third margin portion are continuously formed in the outer margin portion of the fastener element as described above, though there is a possibility of a defect such as a burr in the boundary portion between the second margin portion and the third margin portion, a defect such as a burr can be prevented from arising in the outer margin portion of the fastener element, for example, by the second margin portion and the third margin portion being formed with spacing therebetween.

MODE FOR CARRYING OUT THE INVENTION

A preferred embodiment of the invention will be described below in detail by citing examples and referring to drawings. However, the invention is not limited to the embodiment described below and various alterations can be made insofar as the configuration is substantially the same as that of the invention and similar working and effects are achieved.

For example, in a fastener element of Example 1 described below, the method of manufacturing the fastener element is not particularly limited. That is, fastener elements in the invention include metallic elements manufactured by successively cutting a long wire (Y bar) whose cross section has a Y shape, metallic elements manufactured by punching or cutting a rectangular wire material into an element shape, and metallic elements manufactured by die casting.

EXAMPLE 1

Figure 1:
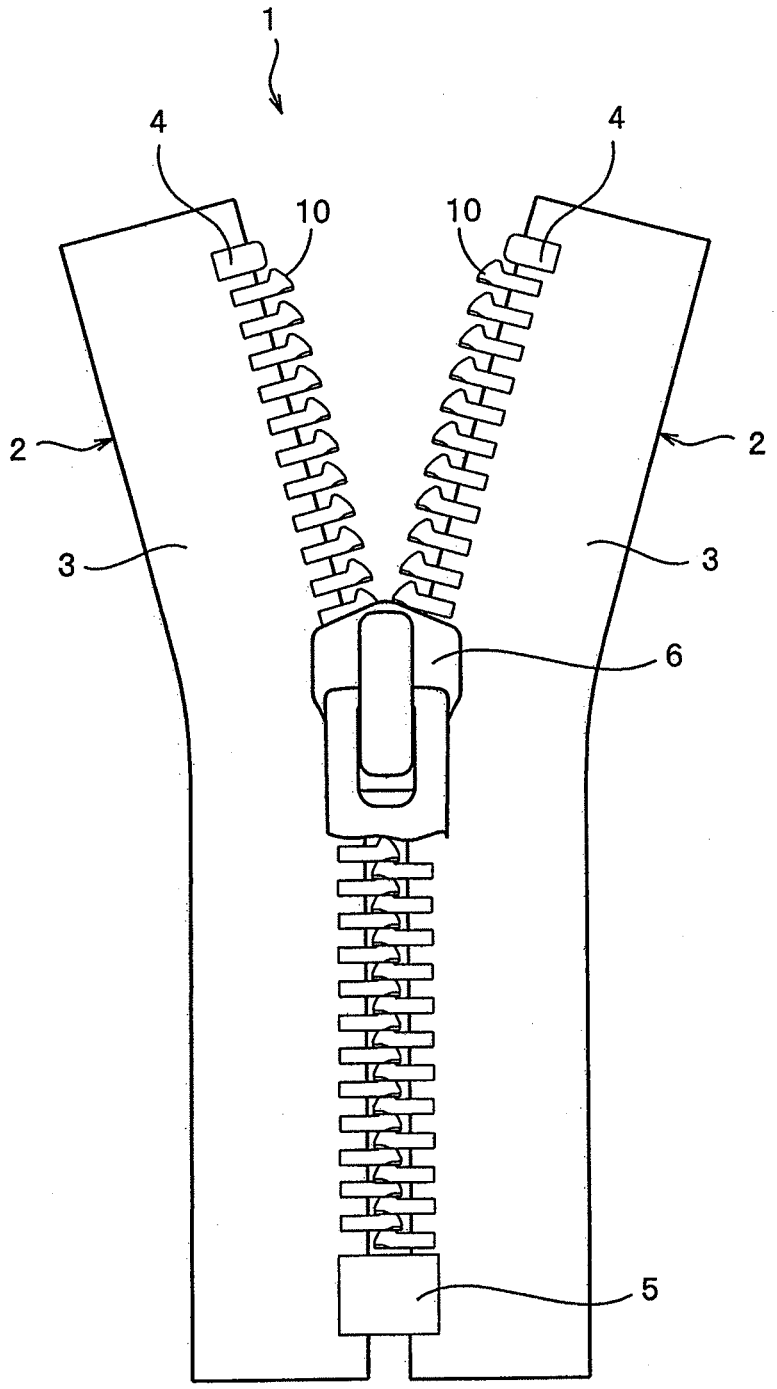
FIG. 1 is a schematic diagram showing a slide fastener according to Example 1 of the invention.
Figure 2:
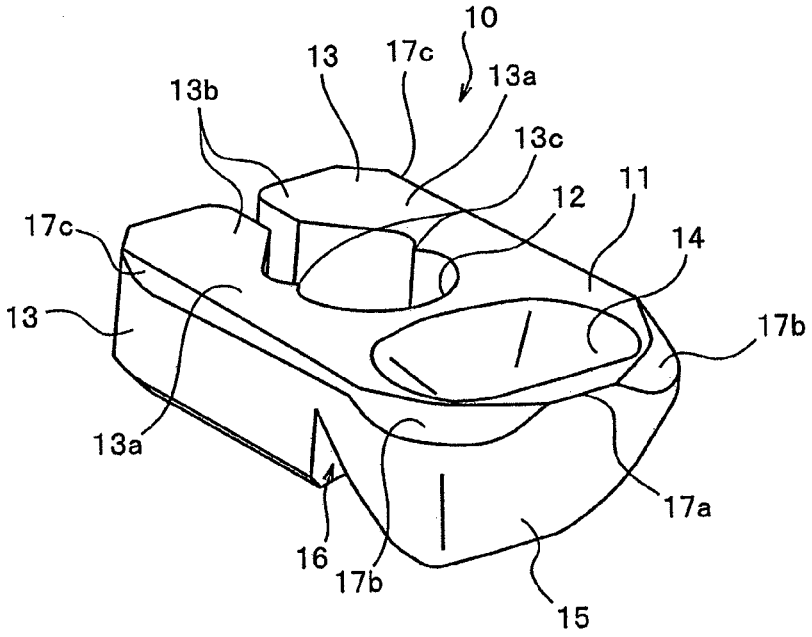
FIG. 2 is a perspective view of a fastener element attached to the slide fastener.
Figure 3:
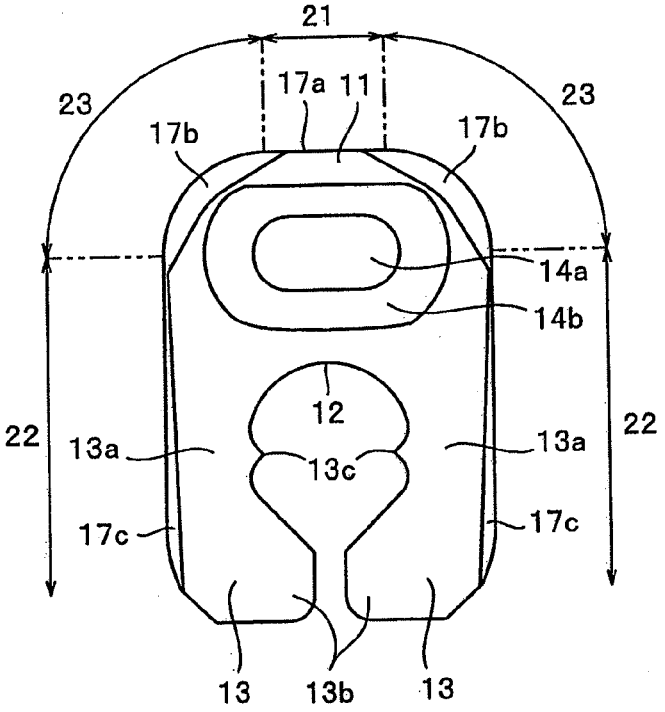
FIG. 3 is a plan view of the fastener element.

FIG. 1 is a schematic diagram showing a slide fastener according to Example 1. FIGS. 2 and 3 are a perspective view and a plan view showing a fastener element attached to the slide fastener.

In the description below about the fastener element, an element up and down direction is an orientation to be a fastener tape length direction when the fastener element is attached to the tape and particularly, the first surface side on which the coupling concave portion of the fastener element is formed is set as a lower surface side and the second surface side on which the coupling convex portion is formed is set as a upper surface side.

An element longitudinal direction (or a forward and backward direction) is an orientation to be a fastener tape width direction when the fastener element is attached to the fastener tape and particularly, the tip end side of the coupling head is set as the forward and the leg portion extending side as the backward. Further, an element width direction (or a left and right direction) is an orientation to be a tape front and back direction when the fastener element is attached to the fastener tape.

The slide fastener 1 according to Example 1 includes a pair of fastener stringers 2 on which an element row is formed by a plurality of the fastener elements 10 made of metal being attached in a row to opposed tape side edges of a pair of fastener tapes 3, a first stop 4 (also called a top stop) disposed on one end of each of the fastener stringers 2 and adjacent to the element row, a second stop 5 (also called a bottom stop) disposed like extending over both ends of the pair of fastener stringers 2 and adjacent to the element row, and a slider 6 disposed slidably along the element row.

The slide fastener 1 according to Example 1 is characterized by the form of the fastener element 10 and members other than the fastener element 10 use conventional ones. Therefore, in the description that follows, the configuration of the fastener element 10 will be described in detail and a detailed description of members other than the fastener element 10 is not repeated.

The fastener element 10 according to Example 1 is formed of a metal such as a copper alloy, nickel alloy, aluminum alloy or the like and a plurality of the fastener elements 10 is attached to the tape side edge of the fastener tape 3 along the tape length direction at regular intervals.

As shown in FIGS. 2 and 3, each of the fastener elements 10 includes a coupling head 11 and a pair of left and right leg portions 13 bifurcated and extended backward from the coupling head 11 via a hip 12 and is configured symmetrically with respect to a surface passing through the center of the element width direction as a symmetry plane. FIGS. 2 and 3 show the fastener element 10 attached to the fastener tape 3 and the fastener element 10 before being attached has the left and right legs 13 straddling from the hip 12 to the element width direction and has a form in a substantial Y shape when the fastener element 10 is viewed from the upper surface side or the lower surface side.

A coupling concave portion 14 is provided on the lower surface of the coupling head 11 in the fastener element 10 and a coupling convex portion 15 projects upward like a mountain in a position corresponding to the coupling concave portion 14 on the upper surface side of the coupling head 11.

The coupling concave portion 14 is formed so as to exhibit a substantial elliptical shape that is long in the width direction when the fastener element 10 is viewed from the lower surface side and includes a lower surface portion 14*a* disposed substantially parallel to the lower surface of the fastener element 10 and an inner wall surface portion 14*b* inclined in a tapering shape from the lower surface portion 14*a* toward the lower surface (first surface) of the fastener element 10.

The left and right leg portions 13 include leg portion bodies 13*a* extended backward from the coupling head 11, claw portions 13*b* disposed on back ends of the leg portion bodies 13*a* like overhanging in directions closer to each other (inward), and protruding portions 13*c* protruding from opposed inner surfaces of the left and right leg portion bodies 13*a*. The fastener element 10 according to Example 1 having the leg portions 13 as described above is stably attached to the fastener tape 3 in a predetermined posture by a core thread portion (not show) of the fastener tape 3 being sandwiched between the left and right leg portions 13.

In addition, a notch portion 16 that separates the coupling convex portion 15 and the left and right leg portions 13 is formed on the upper surface side of the fastener element 10 according to Example 1 and accordingly, the left and right fastener elements 10 can reliably be engaged by causing the coupling convex portion 15 of each of the fastener elements 10 to fit stably into the coupling concave portion 14 of the fastener element 10 of the engaging counterpart when the slide fastener 1 is closed and further, engaging strength or strength with respect to bending of the closed slide fastener 1 can be increased.

As shown in FIG. 3, the outer margin portion on the lower surface side of the fastener element 10 according to Example 1 includes a tip parallel region 21 disposed on the front end side (top surface side) of the coupling head 11 and parallel to the element width direction, left and right side edge regions 22 disposed along the element longitudinal direction over the coupling head 11 and the leg portions 13, and a pair of curved regions 23 disposed in a curved shape between the tip parallel region 21 and the left and right side edge regions 22.

In Example 1, the tip parallel region 21 in the outer margin portion on the lower surface side of the fastener element 10 is not chamfered and a first margin portion (ridge line portion) 17*a* formed as a ridge line is disposed. That is, the first margin portion 17*a* is formed as a non-chamfered portion such that the cross section has a square outer shape at substantially right angles by the lower surface and outer side face of the coupling head 11 being crossed. Particularly, the first margin portion 17*a* is disposed in the center portion of the element width direction correspondingly with respect to the hip 12 of the fastener element 10 across the coupling concave portion 14.

With the first margin portion 17*a* being provided positively in the tip parallel region 21 on the front end side of the coupling head 11, the thickness (top surface side thickness) in the element longitudinal direction from the inner wall surface of the coupling concave portion 14 to the top surface (front end side outer side face) of the coupling head 11 can easily be maintained within required dimensions near the lower surface side of the front end portion of the coupling head 11, for example, without the need to increase the thickness in the up and down direction of the fastener element 10 more than necessary.

Accordingly, the strength (particularly, the strength in the center portion of the element width direction) of the front end portion of the coupling head 11 in Example 1 can stably be maintained and, as will be described later, a large strength with respect to transverse pulling of the slide fastener 1 can stably be obtained.

Incidentally, the first margin portion 17*a* of the invention only needs to be formed like a ridge line that is more square than a second margin portion 17*b* described later by the lower surface and outer side face of the coupling head 11 and, for example, the corner where the lower surface and the outer side face cross may slightly be shaved or exhibit a tiny curved shape by press working or cutting during manufacture of the fastener element 10.

With both of the left and right sides of the first margin portion 17*a* chamfered, the outer edge shape from the lower surface to the outer side face of the coupling head 11 when viewed as a cross section is formed like a downward inclined surface or a pair of the left and right second margin portions (chamfer) 17*b* formed in a convexly curved surface shape like swelling to the outer side are disposed adjacent to the first margin portion 17*a*. In this case, the outer surface shape from the lower surface to the outer side face of the coupling head 11 in each of the second margin portions 17*b* is finished more smoothly than the first margin portion 17*a* formed like a ridge line.

In Example 1, the left and right second margin portions 17*b* are provided so as to cover the entire curved regions 23 in the outer margin portion of the fastener element 10 and one end of the left and right second margin portions 17*b* on the first margin portion 17*a* side is arranged on the inside of positions of both ends in the width direction of the coupling concave portion 14 in the element width direction (left and right direction) with respect to the coupling concave portion 14, particularly on the inside of positions of both ends in the width direction of the lower surface portion 14*a* of the coupling concave portion 14 when the fastener element 10 is viewed from the lower surface side.

In this case, the interval between one ends of the left and right second margin portions 17*b* on the first margin portion 17*a* side, that is, the interval between both ends of the first margin portion 17*a* in the element width direction is set to the size of 20% or more and 65% or less, preferably 25% or more and 50% or less of the maximum dimension of the coupling head 11 in the element width direction.

With the interval between both ends of the first margin portion 17*a* set to 20% or more of the maximum width dimension of the coupling head 11, the forming region (forming area) of the first margin portion 17*a* can stably be maintained and the strength of the front end portion of the coupling head 11 can reliably be increased. In addition, with the interval between both ends of the first margin portion 17*a* set to 65% or less of the maximum width dimension of the coupling head 11, the second margin portion 17*b* in a smooth outer surface shape can be provided in the curved region 23 with which the user's hand comes easily into contact in the outer margin portion on the first surface side of the coupling head 11, thereby effectively improving the feel of the fastener element 10.

Further, the other end on the leg portion 13 side of the left and right second margin portions 17*b* is arranged on the side of the leg portion 13 of an edge position on the front end side of the coupling concave portion 14 in the element longitudinal direction (forward and backward direction) with respect to the coupling concave portion 14, particularly on the side of the leg portion 13 of the edge position of the front end side in the lower surface portion 14*a* of the coupling concave portion 14 when the fastener element 10 is viewed from the lower surface side. Accordingly, the second margin portion 17*b* having a smooth outer surface shape can stably be provided in a range wider than the curved region 23 in the outer margin portion of the coupling head 11.

In this case, the second margin portion 17*b* is formed away from the coupling concave portion 14 by setting the size or angle of the inclined surface or curved surface to predetermined sizes. Accordingly, the lower surface of the fastener element 10 is formed as a continuous single plane between the second margin portion 17*b* and the coupling concave portion 14 from the front end portion of the coupling head 11 to the left and right leg portions 13 via regions on both of the left and right sides of the coupling concave portion 14. With the lower surface of the fastener element 10 formed as a continuous plane without segmentation by being provided with the second margin portions 17*b*, the strength of the periphery of the coupling concave portion 14 can stably be maintained.

Further in Example 1, the outer edge shape when viewed as a cross section is formed in a downward inclined surface shape like being chamfered from the lower surface and the upper surface to the outer side face of the leg portions 13 or a pair of left and right third margin portions (chamfer) 17*c* formed in a convexly curved surface shape like swelling to the outer side is disposed in the outer margin portion on the lower surface side and the outer margin portion on the upper surface side in the left and right leg portions 13.

In this case, the third margin portion 17*c* provided on the lower surface side of the leg portion 13 is provided continuously from the second margin portion 17*b* and continuously formed in the region from the other end of the second margin portion 17*b* to the back end side of the leg portion 13. On the other hand, the third margin portion 17*c* provided on the upper surface side of the leg portion 13 is continuously formed from the position of the notch portion 16 provided on the upper surface side of the fastener element 10 to the back end side of the leg portion 13.

With the third margin portion 17*c* described above disposed in the outer margin portions on the lower surface side and upper surface side of the left and right leg portions 13, the outer surface shape of the outer margin portions can be formed smoothly and therefore, the feel and appearance of the fastener element 10 can further be improved. In addition, sliding resistance of the slider 6 to the fastener element 10 can be reduced to a minimum and therefore, opening and closing operations of the slide fastener 1 can be performed more smoothly by improving operability of the slider 6.

The slide fastener 1 in Example 1 configured as described above has the second and third margin portions 17*b*, 17*c* whose outer surface shape is finished, as described above, as a smooth work surface like being obtained by cutting away corners from the outer surface shape disposed in the predetermined positions in the outer margin portion of each of the fastener elements 10. Thus, for example, when the user inserts his (her) hand into the opening of the slide fastener 1 after opening the slide fastener 1 by sliding the slider 6, the user can sense a smooth feel when the hand touches the fastener element 10 without feeling displeasure like a rough feel of prickling or a slightly scratched feel from the fastener element 10.

Figure 4:
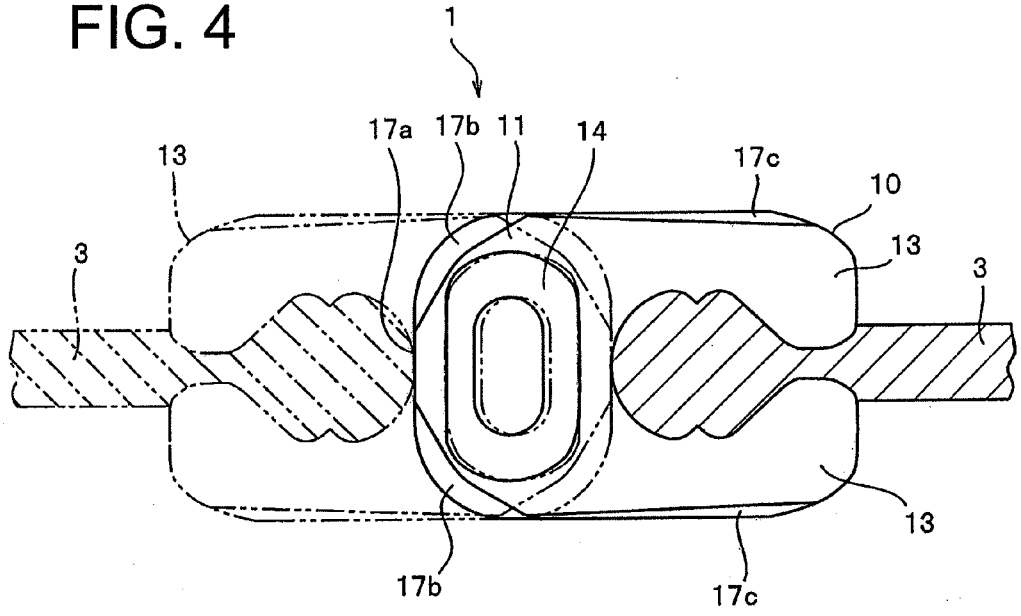
FIG. 4 is a schematic diagram showing a state in which left and right fastener elements are engaged in the slide fastener.
Figure 5:
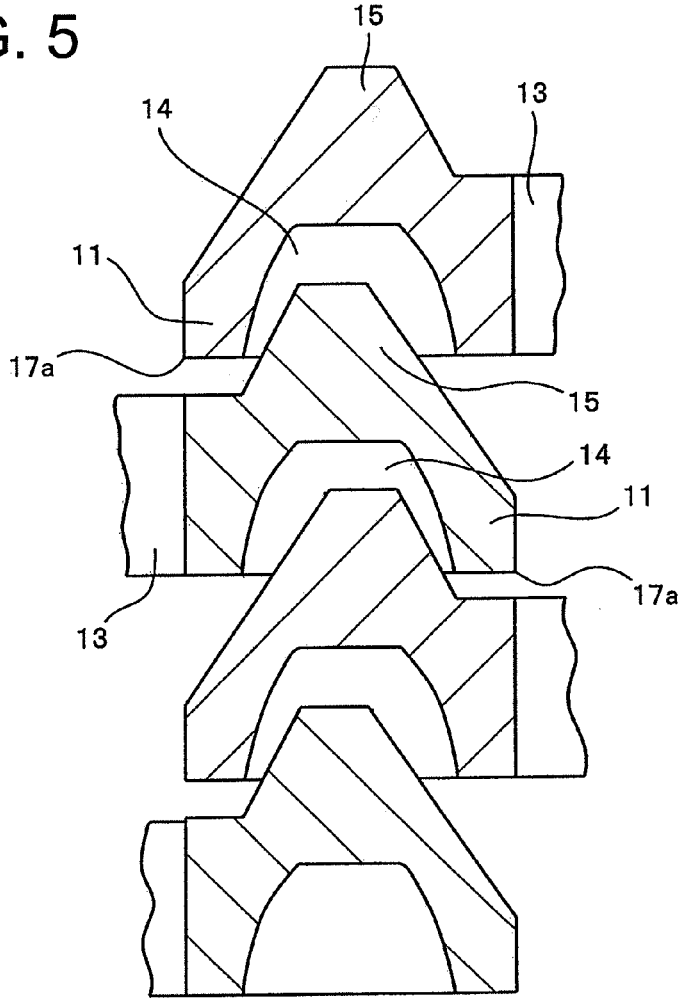
FIG. 5 is a principal portion sectional view showing the state in which left and right fastener elements are engaged in the slide fastener as a cross section.

In the slide fastener 1 in Example 1, by slidingly moving the slider 6 in the engaging direction of the fastener element 10, as shown in FIGS. 4 and 5, the left and right fastener elements 10 can successively be engaged by fitting the coupling convex portion 15 of the fastener element 10 into the coupling concave portion 14 of the fastener element 10 of the engaging counterpart and the slide fastener 1 can thereby be closed smoothly.

At this point, in the slide fastener 1 in Example 1, the first margin portion 17*a* like a ridge line is disposed in the tip parallel region 21 of each of the fastener elements 10 and thus, as described above, the thickness in the element longitudinal direction from the inner wall surface of the coupling concave portion 14 to the front end side outer side face (top surface) of the coupling head 11 has a required size and the strength of the front end portion of the coupling head 11 is thereby stably maintained.

Accordingly, when the slide fastener 1 is subjected to an external force in a closed state, even if the coupling convex portion 15 of the fastener element 10 touches and presses against the inner wall surface of the coupling concave portion 14 of the engaging counterpart (particularly, the inner wall surface on the front end side of the coupling concave portion 14), the coupling head 11 of the engaging counterpart can be prevented from plastically being deformed by its pressing force. Accordingly, the state in which the coupling convex portion 15 is fitted into the coupling concave portion 14 of the engaging counterpart can stably be maintained.

Therefore, in Example 1, a large strength with respect to transverse pulling in the slide fastener 1 and further, a large strength with respect to bending or pushing up can stably be obtained and chain breaking can be prevented in the closed slide fastener 1.

In the fastener element 10 in Example 1, as described above, the third margin portion 17*c* having a smooth outer surface shape is respectively disposed in the outer margin portion on the lower surface side and the outer margin portion on the upper surface side in the left and right leg portions 13. In this case, the third margin portion 17*c* on the lower surface side is continuously formed from the other end of the second margin portion 17*b* to the back end side of the leg portion 13 and the third margin portion 17*c* on the upper surface side is continuously formed from the position of the notch portion 16 of the fastener element 10 to the back end side of the leg portion 13.

In the invention, however, the forming region or form of the third margin portion disposed in the outer margin portion of a leg portion 33 can arbitrarily be changed. For example, like a fastener element 30 according to a modification of Example 1 shown in FIG. 6, the forming region of the third margin portion 37*c* disposed on the lower surface side and the upper surface side of the leg portion 33 can be smaller than in Example 1 described above.

To be more specific, in the fastener element 30 according to the modification, a third margin portion 37*c* on the lower surface side of the leg portion 33 is disposed in a region on the back side of the position of a hip 32 of the fastener element 30 in the element length direction and is provided, in contrast to Example 1 described above, by being spaced from a second margin portion 37*b*.

The third margin portion 37*c* on the upper surface side of the leg portion 33 is also disposed in a region on the back side of the position of the hip 32 of the fastener element 30 in the element length direction and is provided by being spaced from a notch portion 36 disposed on the upper surface side of the fastener element 30.

Even when the third margin portion 37*c* is disposed in a region on the back side of the position of the hip 32 of the fastener element 30 as described above, the feel and appearance of the fastener element 30 can partially and effectively be improved and also operability of the slider 6 can be improved.

Particularly in this case, with one end on a coupling head 31 side of the third margin portion 37*c* on the lower surface side of the leg portion 33 and one end on the coupling head 31 side of the third margin portion 37*c* on the upper surface side disposed in the same position in the element length direction, the appearance of the fastener element 30 is further improved so that appearance quality of the slide fastener can enhanced.

In addition, in the fastener element 10 in which, for example, like Example 1 described above, the second margin portion 17*b* and the third margin portion 17*c* are continuously formed, a defect such as a burr may arise in a boundary portion between the second margin portion 17*b* and the third margin portion 17*c* if the second margin portion 17*b* and the third margin portion 17*c* are formed separately, instead of a single process.

Figure 6:
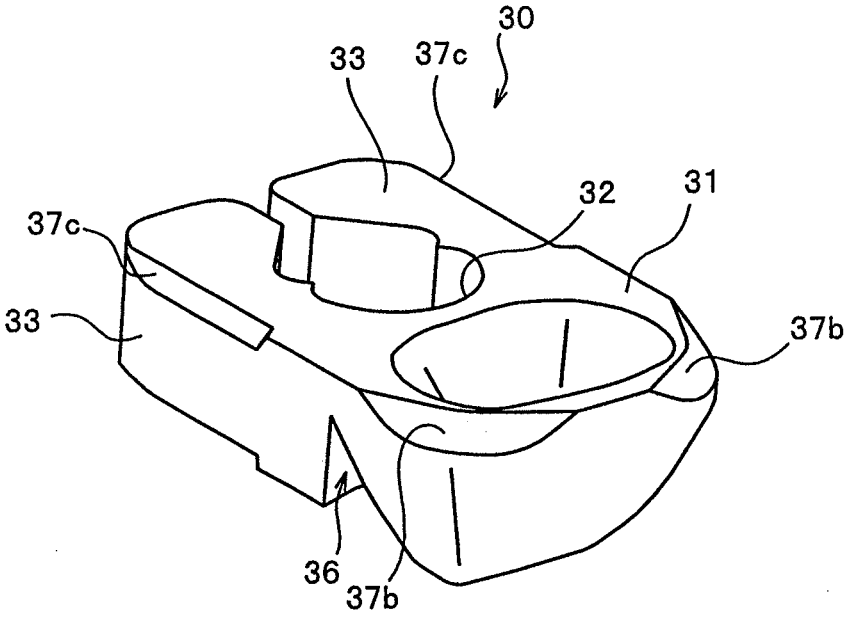
FIG. 6 is a perspective view showing a fastener element according to a modification of Example 1.
Figure 7:
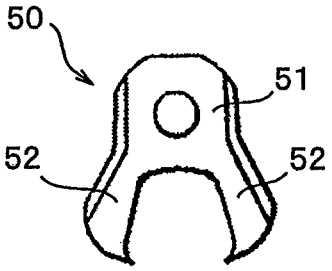
FIG. 7 is a plan view showing a conventional fastener element.

In contrast, with the second margin portion 37*b* and the third margin portion 37*c* formed by being spaced from each other like the fastener element 30 according to the modification shown in FIG. 6, a defect such as a burr in an outer margin portion of the fastener element 30 can reliably be prevented from arising even if the second margin portion 37*b* and the third margin portion 37*c* are formed separately.

Further in the invention, a fastener element may be formed by omitting the formation of the third margin portion itself if necessary and forming the outer margin portion on the lower surface side and the upper surface side of the leg portion like a square ridge line.

DESCRIPTION OF REFERENCE NUMERALS

1 Slide fastener
2 Fastener stringer
3 Fastener tape
4 First stop (top stop)
5 Second stop (bottom stop)
6 Slider
10 Fastener element
11 Coupling head
12 Hip
13 Leg portion
13*a* Leg portion body
13*b* Claw portion
13*c* Protruding portion
14 Coupling concave portion
14*a* Lower surface portion
14*b* Inner wall surface portion
15 Coupling convex portion
16 Notch portion
17*a* First margin portion (ridge line)
17*b* Second margin portion (chamfer)
17*c* Third margin portion (chamfer)
21 Tip parallel region
22 Side edge region
23 Curved region
30 Fastener element
31 Coupling head
32 Hip
33 Leg portion
36 Notch portion
37*b* Second margin portion
37*c* Third margin portion

The invention claimed is:

1. A fastener element made of metal for a slide fastener including a coupling head and a pair of leg portions bifurcated and extended from the coupling head via a hip and having a coupling concave portion provided on a first surface of the coupling head and a coupling convex portion projecting from a second surface of the coupling head, wherein an outer margin portion on the first surface side of the coupling head has a first margin portion disposed in a center region of a tip end side of the coupling head and formed by the first surface meeting an outer side face of the coupling head and a pair of second margin portions wherein each second margin portion is formed as a downward inclined surface from the first surface to the outer side face and the second margin portions extend from opposite ends of the first margin portion in an element width direction, and an interval between the opposite ends of the first margin portion is less than an interval between opposite ends of the coupling concave portion in the element width direction.

2. The fastener element according to claim 1, wherein ends of the second margin portions opposite the first margin portion are arranged on edge portions of the respective leg portions.

3. The fastener element according to claim 1 wherein the second margin portions are spaced from the coupling concave portion and the first surface of the coupling head is continuously disposed between the second margin portions and the coupling concave portion from a side region of the coupling concave portion to a tip end side region of the coupling head.

4. The fastener element according to claim 1 wherein the interval between the opposite ends of the first margin portion is set to 20% or more and 65% or less of a maximum dimension of the coupling head in the element width direction.

5. The fastener element according to claim 1 wherein the outer margin portion on the first surface side of the fastener element includes a tip parallel region disposed on a tip end side of the coupling head and parallel to the element width direction, a pair of side edge regions disposed along an element longitudinal direction and including the coupling head and the leg portions, and a pair of curved regions connecting the tip parallel region and the side edge regions in a curved shape or a bent shape and each of the second margin portions is disposed throughout the respective curved regions.

6. The fastener element according to claim 1, wherein a third margin portion formed as a downward inclined surface or as a curved surface swelling to an outer side from the first surface to the outer side face is disposed in the outer margin portion on the first surface side of one of the leg portions.

7. The fastener element according to claim 6, wherein the third margin portion is continuously formed with one of the second margin portions.

8. The fastener element according to claim 6, wherein the third margin portion is spaced from one of the second margin portions.

9. The fastener element according to claim 1, wherein each of the second margin portions is a chamfered surface, and the first margin portion is a non-chamfered surface.

10. The fastener element according to claim 1, wherein the inclined surface of each of the second margin portions includes a curved edge swelling to an outer side.

11. The fastener element according to claim 2, wherein the inclined surface of each of the second margin portions includes a curved edge swelling to an outer side.

* * * * *